US010683160B2

(12) United States Patent
Petit

(10) Patent No.: US 10,683,160 B2
(45) Date of Patent: Jun. 16, 2020

(54) APPARATUS, SYSTEM AND METHOD FOR A PILL DISPENSER

(71) Applicant: Nypro Inc., Clinton, MA (US)

(72) Inventor: Robert G. Petit, Clinton, MA (US)

(73) Assignee: NYPRO INC., Clinton, MA (US)

( * ) Notice: Subject to any disclaimer, the term of this patent is extended or adjusted under 35 U.S.C. 154(b) by 0 days.

(21) Appl. No.: 15/433,788

(22) Filed: Feb. 15, 2017

(65) Prior Publication Data

US 2018/0229918 A1 Aug. 16, 2018

(51) Int. Cl.

| | |
|---|---|
| ***B65D 83/04*** | (2006.01) |
| ***A61J 7/00*** | (2006.01) |
| ***A61J 1/14*** | (2006.01) |
| ***A61J 1/03*** | (2006.01) |
| ***A61J 7/02*** | (2006.01) |

(52) U.S. Cl.

CPC ..... *B65D 83/04* (2013.01); *A61J 1/03* (2013.01); *A61J 7/0053* (2013.01); *A61J 7/02* (2013.01); *B65D 83/0409* (2013.01)

(58) Field of Classification Search

CPC ..... A61J 1/03; A61J 1/1412; A61J 7/0076; B65D 83/0409; B65D 83/0445; B65D 25/101; B65D 2215/02

See application file for complete search history.

(56) References Cited

U.S. PATENT DOCUMENTS

| | | | | |
|---|---|---|---|---|
| 5,102,249 | A | 4/1992 | Holloway et al. | |
| 6,471,074 | B2 * | 10/2002 | Coleman | A47F 1/06 211/49.1 |
| 6,530,499 | B1 * | 3/2003 | Coleman | A63H 1/06 221/24 |
| 2006/0151521 | A1 * | 7/2006 | Toker | A61J 7/0076 221/226 |

(Continued)

FOREIGN PATENT DOCUMENTS

| | | | |
|---|---|---|---|
| JP | 2015533732 | A | 11/2015 |
| KR | 1020060030990 | A | 4/2006 |

OTHER PUBLICATIONS

International Search Report; International Application No. PCT/US2018/018395; International Filing Date: Feb. 15, 2018; dated Jun. 22, 2018; 3 Pages.

(Continued)

*Primary Examiner* — Gene O Crawford
*Assistant Examiner* — Kelvin L Randall, Jr.
(74) *Attorney, Agent, or Firm* — Cantor Colburn LLP

(57) ABSTRACT

The disclosure provides at least an apparatus, method and system for a pill dispenser. The pill dispenser may be capable of dispensing a predetermined number of pills, and may include a push button; a container capable of containing a plurality of pills and including, at substantially an end portion thereof, a pill exit, and, on an inner circumference thereof, a threaded track; a cap that removably connects the push button and the container; and a dispenser fittedly (Continued)

positioned within the container. The dispenser may include a spring; threads capable of being rotatably received by the threaded track upon actuation of the push button; at least one pill stop at a portion thereof substantially adjacent to the pill exit; and a ramp therewithin capable of guiding ones of the plurality of pills to the pill stop upon compression of the spring.

9 Claims, 7 Drawing Sheets

(56) References Cited

U.S. PATENT DOCUMENTS

2011/0011884 A1 1/2011 Kindel
2011/0020048 A1* 1/2011 Fukumoto ..... A45D 34/04 401/66
2011/0060457 A1* 3/2011 De Vrught ..... A61J 1/03 700/241
2011/0259910 A1* 10/2011 Knudsen ..... B65D 83/0409 221/97
2013/0256331 A1* 10/2013 Giraud ..... B65D 83/0409 221/1
2013/0292403 A1* 11/2013 Cote ..... B65D 21/0204 221/92
2016/0207691 A1* 7/2016 Benouali ..... B65D 25/101
2017/0183143 A1* 6/2017 Yeo ..... B65D 83/0409

OTHER PUBLICATIONS

Written Opinion of the International Searching Authority; International Application No. PCT/US2018/018395; International Filing Date: Feb. 15, 2018; dated Jun. 22, 2018; 7 Pages.

* cited by examiner

APPARATUS, SYSTEM AND METHOD FOR A PILL DISPENSER

BACKGROUND

Field of the Disclosure

The instant disclosure is directed to containers, and, more particularly, to an apparatus and method for a pill dispenser.

Description of the Background

The use of medications, and particularly of prescription medications, is highly prevalent in modern society. In typical embodiments, these medications, when dispensed as pills, are provided in a bottle having, for example, tamper-proofing and/or child safety mechanisms associated therewith. However, because much prescription medication is taken by elderly and infirm patients, the child safety and tamper-proof mechanisms of known pill bottles are often difficult to use due to arthritis, lack of strength, infirmity, and so on.

Further, even when a tamper-proof and/or child safety bottle top is removed, the pills must be spilled out into the hand of a patient or caregiver. When these pills spill from the bottle, there presently exists no mechanism whereby a particular number of pills may be selected from the bottle. Consequently, if the elderly or infirm tilt the bottle, frequently without particularly fine motor control, far more numerous pills than are desired may be dispensed. Thereafter, the desired number of pills must be selected by hand and the remaining pills carefully put back into the bottle, and finally the inconvenient top must be reconnected to the bottle in order to seal the bottle closed.

Therefore, the need exists for a pill dispenser and a pill dispensing bottle that allows greater selectability in the number of pills dispensed, and that provides improved safety and tamper mechanisms that have limited adverse effects on the ease of use, particularly for the elderly and infirm.

SUMMARY

The disclosure provides at least an apparatus, method and system for a pill dispenser. The pill dispenser may be capable of dispensing a predetermined number of pills, and may include a push button; a container capable of containing a plurality of pills and including, at substantially an end portion thereof, a pill exit, and, on an inner circumference thereof, a threaded track; a cap that removably connects the push button and the container; and a dispenser fittedly positioned within the container. The dispenser may include a spring; threads capable of being rotatably received by the threaded track upon actuation of the push button; at least one pill stop at a portion thereof substantially adjacent to the pill exit; and a ramp therewithin capable of guiding ones of the plurality of pills to the pill stop upon compression of the spring. The rotatable reception of the threads by the threaded track upon actuation of the push button compresses the spring and thereby places the guided ones of the plurality of pills at the pill stop, and an inverse rotatable reception of the threads upon release of the push button decompresses the spring and may, in certain embodiments, thereby move the pill stop out of contact with the guided ones of the pills to release the predetermined number of pills from the pill exit.

The pill dispenser may further include tamper-proofing. The pill dispenser may further include a safety alignment mechanism, such as a ridge on one of the outer surface of the push button or the inner surface of the cap, and a corresponding groove on one of the inner surface of the cap or an outer surface of the push button, respectively and by way of non-limiting example.

The disclosed methods may include a method of providing a pill bottle capable of dispensing a single pill. This method may include interlocking a push button with a cap; interlocking a container with the cap along a cross-sectional plane of the cap opposite the push button; providing a track in the container capable of receiving threads; providing a spring within the container capable of compression responsive to the threads being received by the track upon actuation of the push button; and integrating a pill ramp and dispensing hole with the spring, wherein the pill ramp is capable of progressing the single pill down the pill ramp upon compression of the spring for dispensing of the single pill from the dispensing hole.

Thus, the disclosure provides an apparatus, system and method for a pill dispenser and a pill dispensing bottle that allows greater selectability in the number of pills dispensed, and that provides improved safety and tamper mechanisms that only minimally the ease of use, particularly for the elderly and infirm.

BRIEF DESCRIPTION OF THE DRAWINGS

The exemplary compositions, systems, and methods shall be described hereinafter with reference to the attached drawings, which are given as non-limiting examples only, in which.

DETAILED DESCRIPTION

Figure 1:
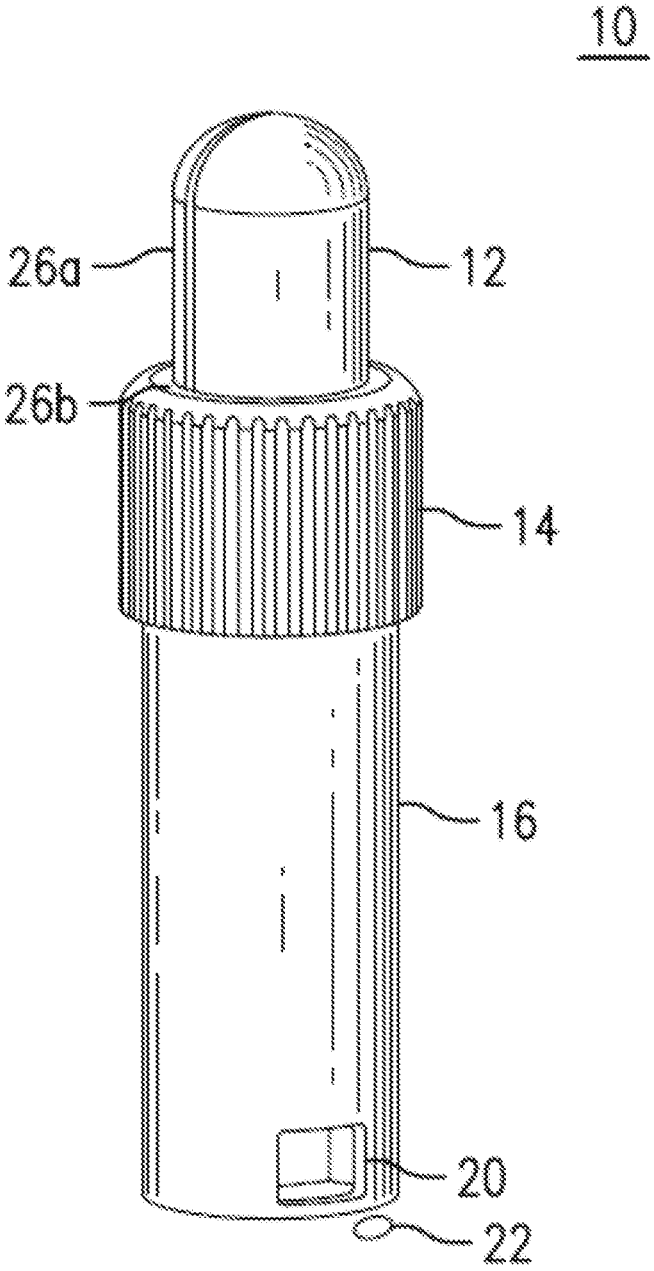
FIG. 1 is an illustration of aspects of a pill dispenser in a certain embodiment.

The figures and descriptions provided herein may have been simplified to illustrate aspects that are relevant for a clear understanding of the herein described apparatuses, systems, and methods, while eliminating, for the purpose of clarity, other aspects that may be found in typical similar devices, systems, and methods. Those of ordinary skill may thus recognize that other elements and/or operations may be desirable and/or necessary to implement the devices, systems, and methods described herein. But because such elements and operations are known in the art, and because they do not facilitate a better understanding of the present disclosure, for the sake of brevity a discussion of such elements and operations may not be provided herein. However, the present disclosure is deemed to nevertheless include all such elements, variations, and modifications to the described aspects that would be known to those of ordinary skill in the art.

Embodiments are provided throughout so that this disclosure is sufficiently thorough and fully conveys the scope of the disclosed embodiments to those who are skilled in the art. Numerous specific details are set forth, such as examples of specific components, devices, and methods, to provide a thorough understanding of embodiments of the present disclosure. Nevertheless, it will be apparent to those skilled in the art that certain specific disclosed details need not be employed, and that embodiments may be embodied in different forms. As such, the embodiments should not be construed to limit the scope of the disclosure. As referenced above, in some embodiments, well-known processes, well-known device structures, and well-known technologies may not be described in detail.

The terminology used herein is for the purpose of describing particular embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The steps, processes, and operations described herein are not to be construed as necessarily requiring their respective performance in the particular order discussed or illustrated, unless specifically identified as a preferred or required order of performance. It is also to be understood that additional or alternative steps may be employed, in place of or in conjunction with the disclosed aspects.

When an element or layer is referred to as being "on", "upon", "connected to" or "coupled to" another element or layer, it may be directly on, upon, connected or coupled to the other element or layer, or intervening elements or layers may be present, unless clearly indicated otherwise. In contrast, when an element or layer is referred to as being "directly on," "directly upon", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). Further, as used herein the term "and/or" includes any and all combinations of one or more of the associated listed items.

Yet further, although the terms first, second, third, etc. may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the embodiments.

The disclosed embodiments are and include a pill dispensing bottle capable of dispensing a single pill, or only a predetermined number of pills, in a manner that is easy to actuate. The disclosed embodiments may also provide improved tamper-proofing and child safety for the disclosed pill dispensing bottle, and thereby also provide greater efficiency and user security in addition to the enhanced ease of use.

The bottle may include a large, easy to grasp and push, such as with a thumb, push button at the topmost portion thereof. The push button may provide a circumferential cross section, such as being circular or ovular in nature, although other cross-sectional buttons may be used with certain of the embodiments, as will be understood in light of the discussion herein. Each push of the push button may dispense only one pill, or only a predetermined number of pills, from a pill dispensing hole at the base of the bottle, irrespective of the orientation of the bottle when the push button is actuated.

Those skilled in the art will appreciate that although the dispensing of one pill may be discussed in certain of the examples herein, other numbers of pills, such as two or three, may also be dispensed responsive to a single push of the push button. Moreover, certain of the embodiments ensure that the predetermined number of pills will not fall out of the pill dispensing hole until the push button is released. In short, in these certain ones of the embodiments and upon release of the push button, the predetermined number of pills and only the predetermined number of pills may be dispensed.

More particularly, the pill dispensing bottle of the embodiments may include at least a container, a dispenser fittedly and rotatably within the container, a cap, and a button. As mentioned, child safety and tamper-proofing may be provided in certain embodiments of the disclosed single pill dispensing bottle, such as through the providing of alignment mechanisms wherein the button becomes operable only in particular alignments, or such as wherein a locking mechanism is provided at the cap such that twisting of the cap into a given orientation locks or unlocks the button from being enabled to move downward when pushed. Moreover, known plastic tamper seals may be provided, such as about the cap and/or about the combination of the cap and the push button, such that pushing of the button may break such a plastic tamper seal to thereby evidence use/tampering. Of course, the button may be locked or sealed using the foregoing or other methodologies for the aforementioned or for other purposes. For example, the bottle may be stored in a pocket or purse without dispensing pills when pills are not desired using the above-referenced lock or seal.

FIG. 1 illustrates a pill dispensing bottle 10 capable of dispensing a predetermined number of pills in accordance with certain of the embodiments. In the illustration of FIG. 1, the pill dispensing bottle 10 includes a push button 12, a cap 14, and a container 16, wherein the container 16 may include a dispensing hole 20 near the base thereof through which the predetermined number of pills 22 may be allowed to exit. As referenced throughout, the button 12 and cap 14 may include one or more alignment mechanisms 26 that allow for the button 12 to be pushed only in certain instances, such as for security, safety, assurance of intent, and tamper-proofing purposes. For example and as illustratively shown, the button 12 may include a groove or ridge **26*a* that must be properly aligned with a receiving ridge or groove 26*b*, respectively, on the inner circumference of the cap 14 before the push button 12** may be pushed downward by a user.

Figure 2:
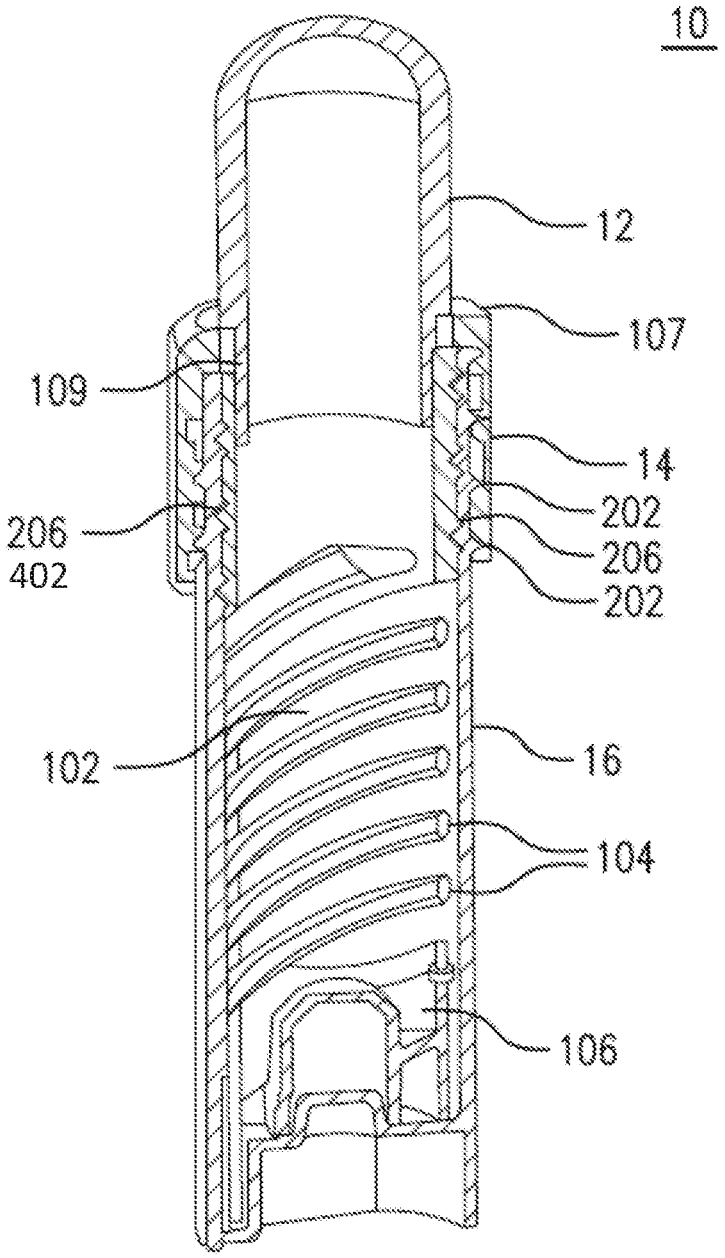
FIG. 2 is an illustration of aspects of a pill dispenser in a certain embodiment.

FIG. 2 illustrates a cross-sectional view of a pill dispensing bottle 10 according to certain of the embodiments. The illustration of FIG. 2 shows an exemplary cross-section of a button 12, the cap 14, and a pill dispenser 102 fittedly within the container 16. The pill dispenser 102 may include a spring portion 104 internal to the container 16, and a pill ramp 106, also internal to the container 16, for dispensing pills 22 from the dispensing hole 20 shown in FIG. 1.

The button 12 may be used to actuate the pill dispenser 102 and thereby dispense a predetermined number of pills 22, such as one pill. As referenced with respect to FIG. 1, the push button 12 may have orientation features 26 which mandate a particular physical orientation in order to unlock the button 12 and allow it to be pressed for dispensing of a pill 22. This orientation feature or features 26 may additionally help to prevent accidental pill dispensing, such as to a child or during intended storage. Needless to say, particularly for the elderly or infirm, the pushing of a button 12 provides enhanced ease of use as compared to the "Press Firmly and Rotate" caps of known pill bottles in the current art. These known pill bottle caps generally require very firm pressure in conjunction with a rotating motion, which can be exceedingly difficult for the elderly or infirm to provide.

The cap 14 may serve to hold the various disclosed parts together, and may further allow for removal of the topmost portion of the bottle, i.e., including the push button 12, such as to allow for pills to be filled or refilled into the container 16. Further and as referenced above, the cap 12 may include mated physical features 26*b* to those physical features 26*a* provided on the push button 12 in order to limit operability of the push button 12 to only safe and desired circumstances. Further, the cap may include mated physical features, such as an inwardly extending (with respect to the center axis of the bottle) lip 107 that may extend over an outwardly extending flange 109 of the push button 12, so as to hold the push button integral with the cap 14. Other mechanisms may be used to integrate the cap 14 and the push button 12 while still allowing for actuation of the push button downwardly within the cap 14, as will be understood to those of skill in the pertinent arts, such as mated threads on the cap 14 and the push button 12, mated slot and groove features on the cap 14 and push button 12 (or vice versa), and so on.

Within the container 16 is the pill dispenser mechanism 102, and protruding through a sidewall of the container 16 is an exit hole 20 from which the predetermined number of pills are dispensed. The container 16 may have a size and shape similar to that of a common pill bottle in the known art, such as having a circular or ovular cross section, although other sizes and shapes for container 16 may be provided in certain of the embodiments. The container 16 may further include, such as at an upper portion and on an outer circumference thereof, a receiving mechanism 202 by which the cap 14 may be suitably and/or temporarily attached to the container 16. Further, substantially along the inner circumference of the container may reside a helical track 206 in which the dispenser 102 may rotate in order to dispense a predetermined number of pills 22 upon actuation of the push button 12. That is, the helical track 206 on the inner circumference of the container 16 may drive the dispenser 102 to rotate when the push button 12 is actuated, such as due to slots or threads on the outer circumference of the dispenser 102. These slots or threads may or may not be or include portions of the spring that is compressed upon actuation of the push button.

Figure 3:
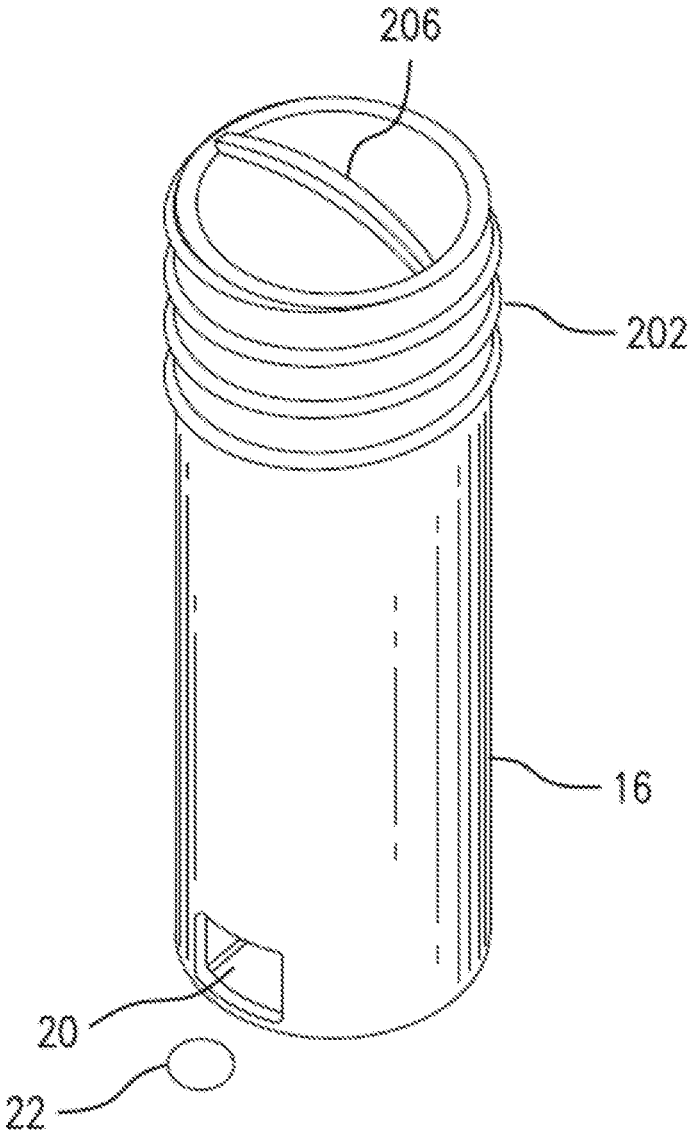
FIG. 3 is an illustration of aspects of a pill dispenser in a certain embodiment.

FIG. 3 is an exemplary illustration of a container 16 in accordance with certain of the embodiments. As shown in FIG. 3, helical groove track 206 may be provided on an inner circumference of the container 16. Moreover, threads 202 may be provided on the outer circumference of the container 16, such as only at the upper portion thereof, for receiving the cap 14, such as for receiving threads on the inner circumference of the cap 14 in order to removably seal the disclosed components together. Finally, a pill dispensing hole 20 is illustrated in FIG. 3.

Figure 4:
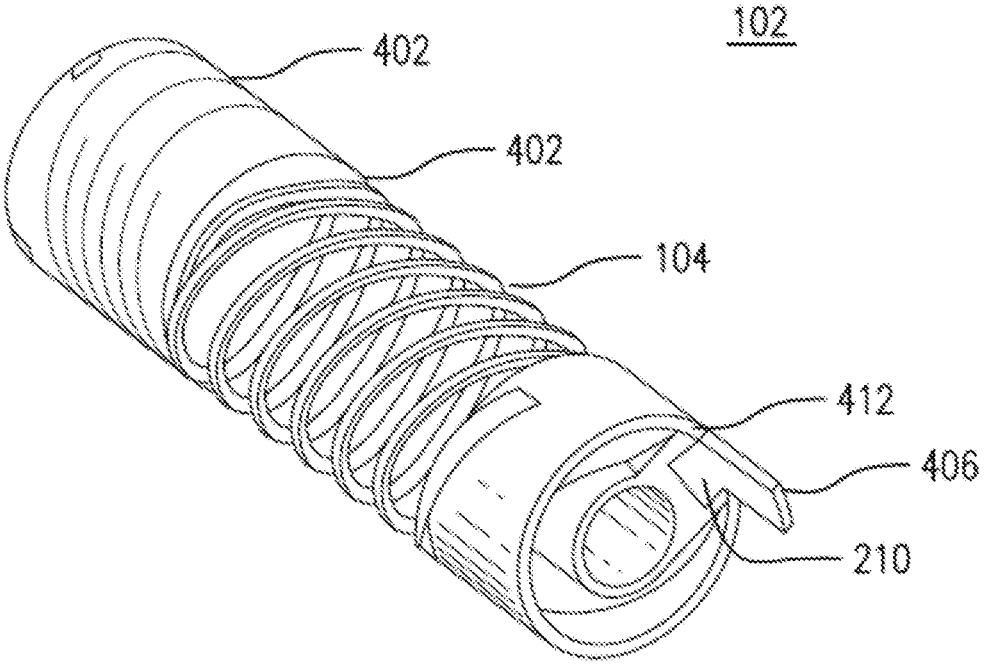
FIG. 4 is an illustration of aspects of a pill dispenser in a certain embodiment.

FIGS. 4A and 4B illustrate a pill dispenser 102 in accordance with certain of the embodiments. As shown, the dispenser 102 may include threads or slots 402 for mating with helical track 206, and a spring portion 104 that is illustratively shown as helical in nature and which may be compressed by the exertion of downward pressure on the topmost portion of dispenser 102 due to actuation of the push button 12. Further illustrated is a pill dispensing hole 210 that limits the dispenser 102 to dispensing only a predetermined number of pills 22 through the hole 210 upon actuation of the push button 12. More particularly, dispensing of the pills 22 is limited by the door 406 of the dispenser 102, which is shown as a tab at a particular point and at a given orientation within the dispenser 102 in the illustrative embodiment of FIG. 4.

Figure 7:
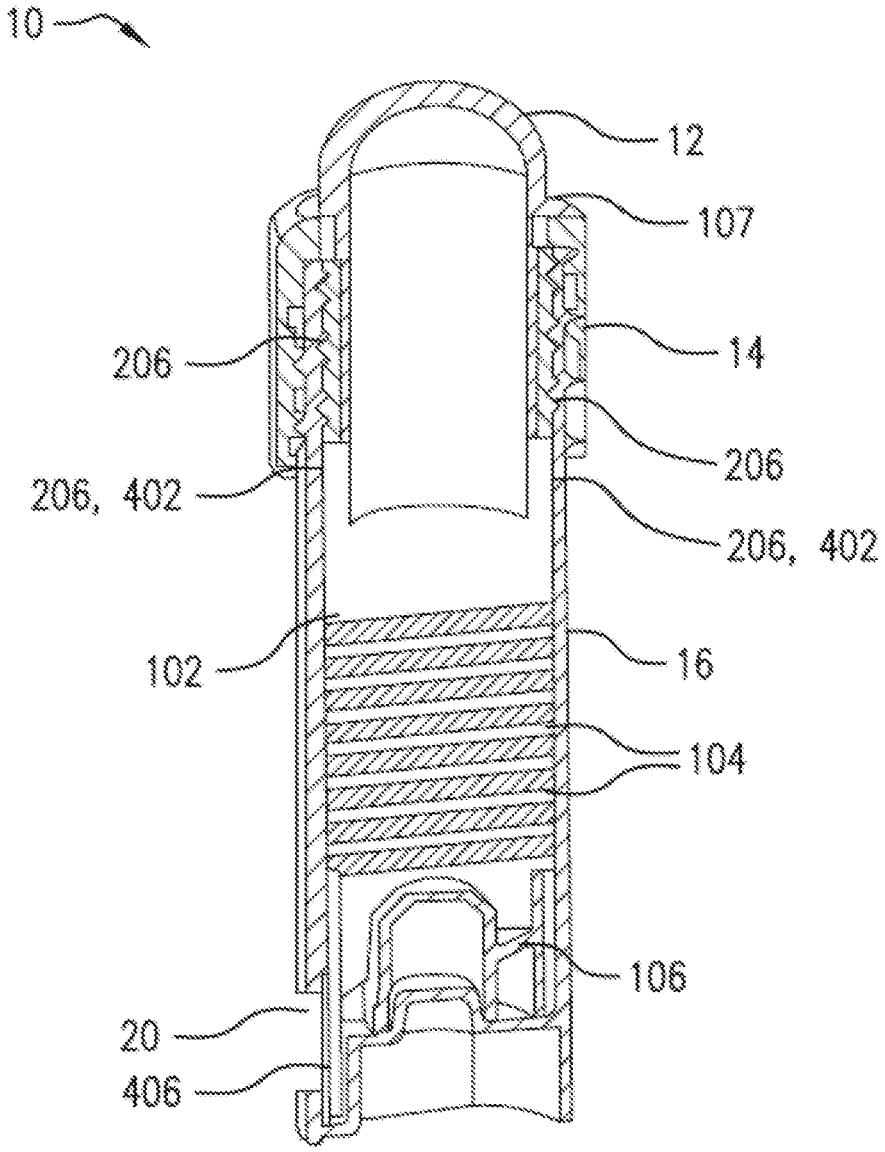
FIG. 7 is an illustration of aspects of a pill dispenser in a certain embodiment.

In operation and as referenced, the spring portion 104 of the dispenser may function and appear as would a spring. That is, when the push button 12 is actuated, the spring portion 104 of the dispenser compresses as would any spring, best shown in FIG. 7. The dispenser's threads 402, such as in consort with the helical grooves of the container 206, may also cause the dispenser 102 to rotate as the spring portion 104 of the dispenser 102 is compressed downward upon actuation of the push button 12.

The imparted rotation causes the door 406 on the dispenser 102 to align with the exit hole 20 of the container 16. Accordingly, a pill 22 or a predetermined number of pills is now dropped against the door 406 in preparation to exit the pill dispensing bottle 10. Once the push button 12 is released, the dispenser spring 104 will return to its relaxed state, and the dispenser door 406 may thereby be rotated out of the way, thus allowing the predetermined number of pills 22 to fall out of the exit hole 20 in the container 16.

In order to provide a pathway for the pill 22 or predetermined number of pills, the dispenser may additionally include a pill ramp 412 which forces the pill 22 to roll toward the exit hole 20 upon compression of the spring portion 104, even if the pill dispensing bottle 10 is tilted out of alignment with or in opposition to gravitational forces. That is, the pill ramp 412 may keep the pills 22 rolling "downhill" within dispenser 102.

Figure 5:
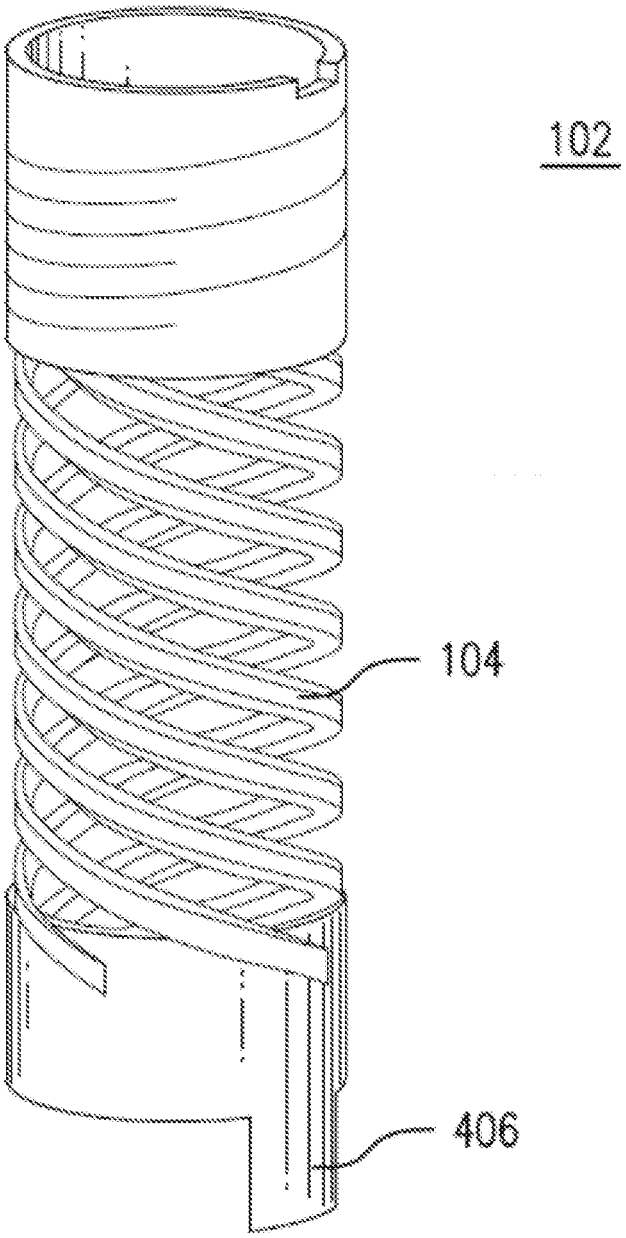
FIG. 5 is an illustration of aspects of a pill dispenser in a certain embodiment.
Figure 6:
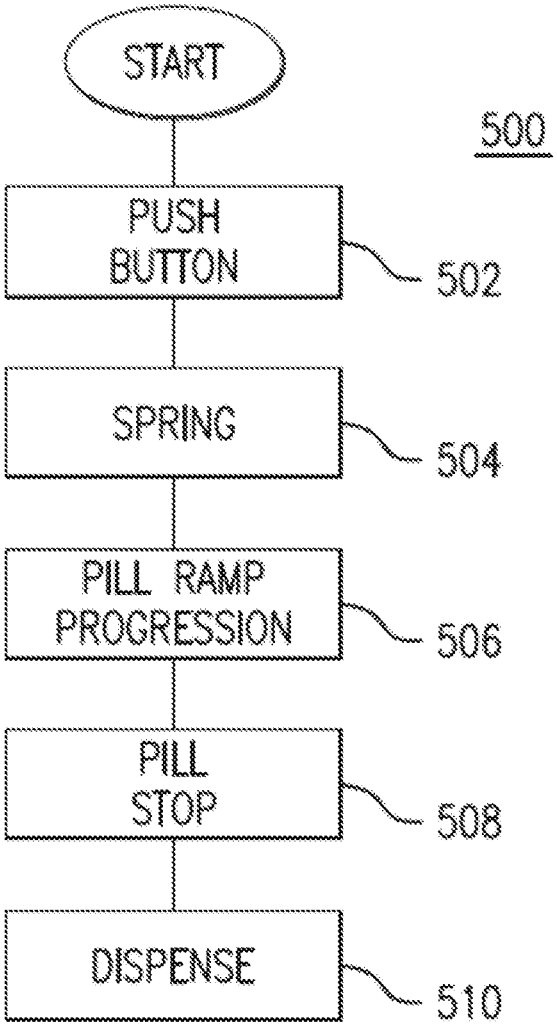
FIG. 6 is a flow diagram illustrating a method of providing a pill dispenser in a certain embodiment.

FIG. 5 is a flow diagram illustrating an exemplary method 500 of making and using a single pill dispensing bottle. At step 502, a push button is provided in association with a container for containing a plurality of pills. At step 504, a spring mechanism is provided in association with the push button, such that actuation of the push button downward causes a downward movement of the push button so as to compress the spring mechanism. A pill ramp is provided at step 506, such that one or more pills are forcedly progressed down the pill ramp by the actuation of the spring at step 504. At step 508, a pill exit stop is provided, such that a predetermined number of pills is held at the provided pill exit stop until release of the push button. At step 510, a pill exit is provided such that, upon release of the pill exit stop, the predetermined number of pills exits the container from the pill exit.

The descriptions of the disclosure are provided to enable any person skilled in the art to make or use the disclosed embodiments. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein, but rather is to be accorded the widest scope consistent with the principles and novel features disclosed herein.

What is claimed is:

1. A pill dispensing bottle capable of dispensing a predetermined number, other than one, of pills, comprising:

a push button;

a container capable of containing a plurality of the pills and including, at substantially an end portion thereof, a pill exit, and, on an inner circumference thereof, a threaded track;

a cap that removably connects the push button and the container;

a dispenser fittedly positioned within the container and comprising:

a spring;

threads capable of being rotatably received by the threaded track upon actuation of the push button;

at least one pill stop; and a ramp capable of guiding the predetermined number of pills to the pill stop upon compression of the spring;

wherein the rotatable reception of the threads by the threaded track upon actuation of the push button compresses the spring, rotates the pill stop into alignment with the pill exit to block the pill exit, and delivers the predetermined number of pills to the pill stop via the ramp, and wherein an inverse rotatable reception of the threads upon release of the push button decompresses the spring and rotates the pill stop out of alignment with the pill exit to release the predetermined number of pills from the pill exit.

2. The pill dispensing bottle of claim 1, wherein the cap further comprises a tamper-proofing.

3. The pill dispensing bottle of claim 1, wherein the cap and the push button together comprise a safety alignment mechanism.

4. The pill dispensing bottle of claim 3, wherein the safety alignment mechanism comprises an orientation limiter.

5. The pill dispensing bottle of claim 4, wherein the orientation limiter comprises a ridge on one of the outer surface of the push button or an inner surface of the cap, and a corresponding groove on one of the inner surface of the cap or an outer surface of the push button, respectively.

6. The pill dispensing bottle of claim 1, wherein the push button has a circular or ovular cross section.

7. The pill dispensing bottle of claim 1, wherein the push button comprises a button lip extending outwardly from a center axis of the bottle at least partially about a portion of the push button, and wherein the cap has a corresponding cap lip extending inwardly toward the center access for engaging the button lip to maintain the push button integral with the cap.

8. The pill dispensing bottle of claim 1, wherein the pill stop comprises a tab.

9. The pill dispensing bottle of claim 1, wherein the pill ramp is operable irrespective of a gravitational orientation of the pill ramp.

* * * * *